United States Patent [19]

Toyoda

[11] 4,252,505

[45] Feb. 24, 1981

[54] ELECTROMAGNETIC PUMP

[75] Inventor: Akira Toyoda, Tokyo, Japan

[73] Assignee: Taisan Industrial Co., Ltd., Tokyo, Japan

[21] Appl. No.: 9,757

[22] Filed: Feb. 5, 1979

[30] Foreign Application Priority Data

Apr. 28, 1978 [JP] Japan ..... 53-56013[U]

[51] Int. Cl.[3] ..... F04B 17/04; F04B 7/00

[52] U.S. Cl. ..... 417/417; 417/505

[58] Field of Search ..... 417/417, 505

[56] References Cited

U.S. PATENT DOCUMENTS

| | | | |
|---|---|---|---|
| 2,801,591 | 8/1957 | Parker | 417/417 X |
| 3,044,401 | 7/1962 | Sawyer | 417/417 X |
| 3,515,966 | 6/1970 | De Valroger et al. | 417/411 X |
| 3,874,822 | 4/1975 | Nakamura | 417/505 X |
| 4,021,152 | 5/1977 | Toyoda | 417/505 X |
| 4,150,924 | 4/1979 | Toyoda | 417/417 |

*Primary Examiner*—Richard E. Gluck
*Attorney, Agent, or Firm*—Gerald Levy

[57] ABSTRACT

An electromagnetic pump characterized in that two independent coils disposed adjacent each other and via a common magnetic path are used for actuating a plunger and a valve, respectively, thereby preventing the generation of noises and abrasion during the operation of the pump. This also attains the quick return of the valve to its home position at the time when the pump stops, thus resulting in the complete stoppage of oil leak.

2 Claims, 4 Drawing Figures

ELECTROMAGNETIC PUMP

BACKGROUND OF THE INVENTION

This invention relates particularly to a solenoid type electromagnetic pump to be operated with intermittent d-c currents obtained by the half-wave rectification of a commercial alternating current power source.

In this type of electromagnetic pump device, strenuous improvements have been made for the prevention of "beat" during operation and also for the rapid stoppage of feeding of oil when stopped.

The beat in this kind of electromagnetic valve is in general originated from the chattering of a valve disposed particularly for controlling the feeding of oil and various countermeasures have been proposed so far. As typical countermeasures, various systems which are driven by currents such as A-C, full-wave rectified current and D-C, for example, have been in service, but each of them has both merits and demerits and therefore exhibits different performance in actual use. In more details, the prevention of beat during operation and the rapid stoppage of the valve when the power is disconnected are substantially antinomic in the case of the electromagnetic valve actuated by alternating current. For the electromagnetic valves driven by direct current or currents obtained by full-wave rectification, the beat may be appreciably reduced, but they are disadvantageous in that power source systems become rather complicated, that the breaking time or time interval from the disconnection of power to the stoppage of the valve becomes longer and that attraction force in a main magnetic circuit used for driving a plunger is decreased.

In addition, it is well known to those skilled in the art that the oil leak after the stoppage of pump is attributed to the time delay until the pump internal pressure or oil head pressure during the feeding through the action of leading-in or suction is diminished, when an oil storage tank is located at a higher or lower position than the place where the pump is installed. In short, in the case of the former, it results in the outflow due to leakage and the so-called after-loose, while for the latter it results in the after-loose. Such phenomena may become the cause of troubles such as the breaking-out of a fire and the occurrence of a nasty smell and a poisonous gas due to incomplete combustion or the explosion within a furnace, so that it has been desired for a long time that an electromagnetic pump which is safe in operation and also cheap in cost can be provided.

Besides, the chattering of the electromagnetic pump, which may be the main cause of noises, causes their surfaces of abutment to wear which in turn further increases its chattering, thus leading the pump to any damage or more leakage of oil at the time when the pump is stopped.

SUMMARY OF THE INVENTION

It is therefore a primary object of the subject invention to provide an electromagnetic pump in which the generation of noises and abrasion during the operation of the pump or during opening of an electromagnetic valve are prevented.

A further object of this invention is to provide an electromagnetic pump in which the quick return of an electromagnetic valve after the disconnection of the power to the electromagnetic pump is attained, thereby preventing the leakage of oil without fail.

BRIEF DESCRIPTION OF THE DRAWINGS

The novel feature of the subject invention as well as the invention itself, and the objects and advantages thereof will be better understood from the accompanying drawings in which like reference numerals refer to like parts and in which.

DESCRIPTION OF THE PREFERRED EMBODIMENTS

Figure 1:
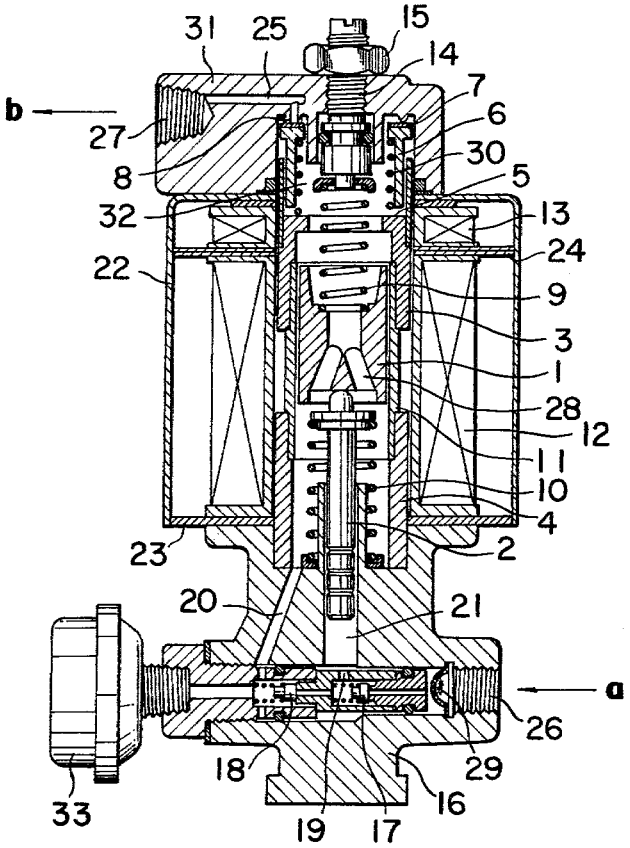
FIG. 1 is a longitudinal and sectional view of a solenoid-type electromagnetic pump according to a first embodiment of the subject invention.

Referring now to FIG. 1 wherein the first preferred embodiment of the solenoid-type electromagnetic pump is illustrated, it is seen that a plunger operating coil 12 and an electromagnetic valve operating coil 13 are disposed adjacent to each other along the line of axis and by way of a magnetic iron plate 24 serving as common magnetic path, and annular yokes 3 and 4 disposed at the inside of the coils form a magnetic path together with the magnetic iron plate 24, an outer casing 22 covering the two coils and a lower plate 23 for the coil 12. In this embodiment, a laminated core may be used for the magnetic iron plate 24. In addition, the yokes 3 and 4 are mounted on the periphery of a plunger sleeve 11 made of non-magnetic material for forming a gas-tight chamber. An electromagnetic plunger 1 which reciprocates within the plunger sleeve 11 is held under pressure between a return spring 10 which is in engagement with the tappet portion of a delivery plunger 2 supported thereby and freely movable along its axial line within a cylinder 21 disposed at the central portion of a main body 16 and an auxiliary spring 9 disposed at the upper part of the plunger sleeve 11 and along the line of axis for the return spring 10. The upper end of the auxiliary spring 9 extends into an electromagnetic valve chamber 32 of an upper body 31 and abuts the lower part of an adjusting screw 14 screwed to the top of the upper body 31. The adjusting screw 14 adjusts a bias pressure to the electromagnetic plunger 1 and is locked by means of a nut 15 after adjustment. The lower plate 23 located at the lower end of the plunger operating coil 12 abuts the upper surface of the main body 16. The yoke 4 fitted into the central hole of the lower plate 23 extends in a lower direction beyond the plate 23 and is pushed into the shoulder portion of the main body 16 and the inside of chamber extending from the main body 16 to the upper body 31 is thereby tightly sealed. An upper end 5 of the upper side yoke 3 terminates at a position somewhat lower than the upper end of the electromagnetic valve operating coil 13 and, at the upper part thereof, a sleeve-like moving magnetic core 6 is disposed inside the chamber 32. The moving magnetic core 6 is being pushed upward by means of a thrust spring 30 disposed within the chamber 32. Disposed at the upper end of the moving magnetic core 6 is a valve made of resilient material such as synthetic rubber and the like which abuts a valve seat 8 disposed at the upper wall inside the valve chamber 32 when the pump is not operated, thereby closing the path located at the center of the valve seat 8. A suction port 26 of the main body 16 communicates with the cylinder 21 through a suction valve 17 and a side hole 19 and, at the same time, communicates with the inside of the plunger sleeve 11 by way of a delivery valve 18 and an extruding path 20.

Figure 2:
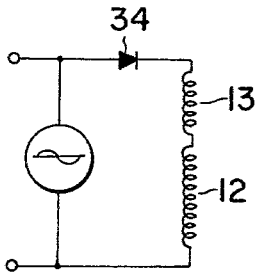
FIG. 2 is an electrical wiring diagram between a power source and a coil portion used in FIG. 1.

The plunger operating electromagnetic coil 12 and the electromagnetic valve operating coil 13 are connected in series in the same polarity and are to be energized by half-wave rectified currents through a rectifier 34, as particularly shown in FIG. 2.

The operation of the electromagnetic pump is hereinafter explained in detail. When the power is initially applied, the electromagnetic valve operating coil 13 is energized to pull down the moving magnetic core 6 until it abuts the upper part 5 of the yoke 3 and a valve 7 is thereby separated from the valve seat 8. Simultaneously, the plunger operating coil 12 is energized to pull the plunger 1 downward. The exciting current to the coils 12 and 13 is supplied in the form of intermittent current. In this case, the strength of the thrust spring 30 against the moving magnetic core 6 is chosen so that the magnetic core 6 does not chatter even during the period for which the exciting current is interrupted and it rapidly returns to its closed position when the power is disconnected. On the contrary, the strength of the return spring 10 and the auxiliary spring 9 to the plunger 1 is determined in such a manner that the plunger 1 can respond as faithfully as possible to the intermittently-supplied magnetic traction force generated by the plunger operating coil 12. Under the continuous operating condition, the reciprocating motion of the plunger 1 due to the intermittent magnetic traction force and the repulsion force of the return spring 10 causes the delivery plunger 2 to reciprocate. A liquid sucked in the direction "a" at the suction port 26 by the reciprocating motion of the electromagnetic plunger 1 and the delivery plunger 2 reaches the cylinder 21 through a filter 29, the suction valve 17 and the side hole 19 on one hand and also reaches the electromagnetic valve chamber 32 through the delivery valve 18, the extruding path 20, the inside of the plunger sleeve 11 and a path 28 passing through the electromagnetic plunger 1 on the other hand, and thereafter, it is delivered in the direction "b" from an outlet port 27 through a path 25 perforated in the upper body 31. The reference numeral 33 shows an accumulator.

As described hereinbefore, the main subject of the present invention resides in the fundamental improvement of antinomy in a conventional electromagnetic pump represented by the fact that the countermeasure for suppressing noises originated from the chattering of an electromagnetic valve generally makes its mechanism complicate and causes a delay in the stopping operation of the valve at the time when the power is disconnected and also adversely affects the operation of the main magnetic circuit. These points will be reviewed in the following paragraph.

Under the state wherein the power is being supplied to the coils, the magnetic force generated by the electromagnetic plunger operating coil 12 moves the electromagnetic plunger 1 downward to increase the permeance of the magnetic circuit constituted by the yoke 4, lower plate 23, outer casing 22, magnetic iron plate 24, the lower side of the yoke 3 and the electromagnetic plunger 1. In addition, the magnetic force generated by the electromagnetic valve operating coil 13 pulls the moving magnetic core 6 downward to increase the permeance of the magnetic circuit represented by the upper side of the yoke 3, magnetic iron plate 24, outer casing 22 and the moving magnetic core 6. Since the coils 12 and 13 are in the same polarity, the magnetic lines of forces in the different directions apparently pass through the magnetic iron plate 24 used as common magnetic path for the coils 12 and 13, and thus the plate 24 is used at the lower level of magnetized condition compared to that of the other magnetic pathes. In actual performance test, it has been found that the rapid return motion of the electromagnetic valve at the time when the power is disconnected is certainly attained. In view of these results, it can be concluded that the magnetic iron plate 24 during operation is used at a lower magnitization level. In the previous paragraph, it is explained that each of the magnetic circuits to the plunger operating coil 12 and the electromagnetic valve operating coil 13 is operating independently of each other, excepting for the magnetized condition in the common magnetic path or magnetic iron plate 24. In addition, it is evident as previously explained that the use of direct current or full-wave rectified current to the electromagnetic valve operating coil 13 adversely affects the magnetic circuit including the main magnetic path or electromagnetic plunger 1.

According to the present invention, such appreciable defects as explained above are substantially eliminated by applying the magnetic fluxes of different polarities induced by half-wave rectified current to the common magnetic path or magnetic iron plate 24. In more details, the generation of chattering or noises is sufficiently suppressed by adequately adjusting the strength of the thrust spring 30 used for supporting the moving magnet core 6 in consideration of the traction forces produced by the electromagnetic valve operating coil 13. Similarly, the counter electromotive force to be produced by the coil 12 during its rest period corresponding to half-period thereto suppresses the generation of that of the coil 13 and vice versa. In particular, since the large counter electromotive force produced in the plunger driving coil influences the small counter electromotive force to be produced in the electromagnetic valve operating coil so as to suppress the latter, the demagnetizing time for the electromagnetic valve operating coil is prolonged and the prevention for the generation of chattering is thereby effectively attained. The abovementioned theory is the result of induction from the performances attained, so that, when the transitional variation of operation in the magnetic circuit including the two coils is taken into consideration as actual circuit, it can be considered that the influence due to the leakage fluxes from the so-called strong magnetic circuit also helps the prevention of chattering. In the embodiment illustrated in FIG. 1, the number of turns for the coils 12 and 13 are 2800 T and 450 T, respectively.

Figure 3:
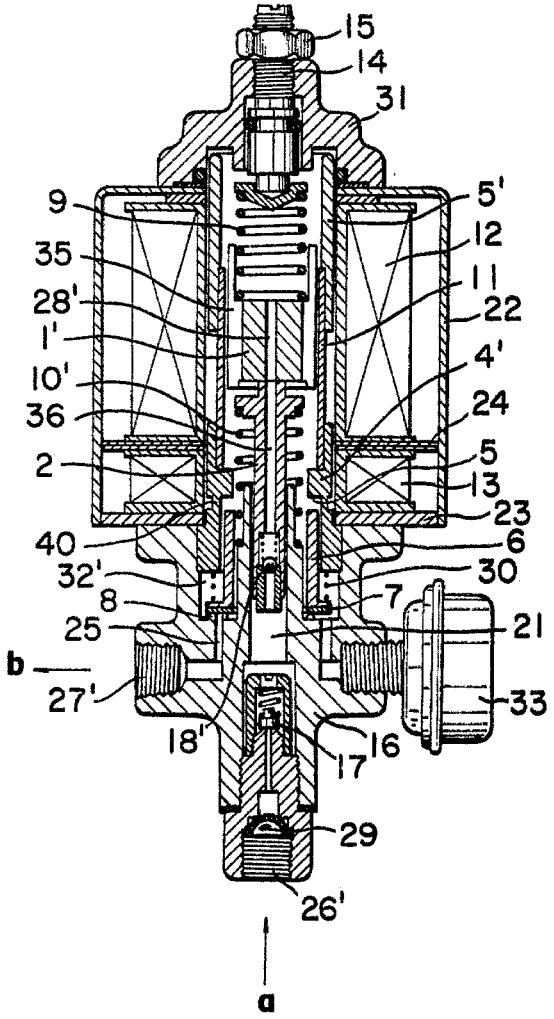
FIG. 3 is a longitudinal and sectional view of a solenoid-type electromagnetic pump according to a second embodiment of the present invention.

Referring now to FIG. 3 showing another application of principles in accordance with this invention, a major difference from the embodiment of FIG. 1 resides in that the electromagnetic plunger operating coil and the electromagnetic valve operating coil are displaced upside down and that an outlet port 27' is located at the lower part. In the drawing, an annular yoke 4' is used as a common magnetic head for the electromagnetic plunger operating coil 12 and the electromagnetic valve operating coil 13, and the moving magnetic core 6 for the electromagnetic valve is located at the upper part and disposed within an electromagnetic valve chamber 32' formed by spreading out the inner hole in the lower edge of the yoke 4'. The valve 7 is disposed at the lower end of the moving magnetic core 6 and the valve seat 8 is disposed at a position corresponding to the valve 7 on the main body 16. In the ordinary state, the valve 7 is mounted on the valve seat 8 through the action of the spring 30 to close the path 25.

FIG. 2 also applies to the connection between the electromagnetic coils 12 and 13 and the half-wave rectified current is applied thereto. During ordinary continuous operation, the electromagnetic plunger 1' reciprocates together with the delivery plunger 2 by the intermittently-supplied magnetic traction force and the repulsion force of the return spring 10. The moving magnetic core 6 is engaged with an abutment surface 5' of the yoke 4' in a similar manner as indicated in FIG. 1. In response to the reciprocating motion of the electromagnetic plunger 1', the liquid is sucked in the direction "a" at the suction port 26' and enters the plunger sleeve 11 through the filter 29, suction valve 17, cylinder 21, delivery valve 18' disposed within the delivery plunger 2, path 36, through-hole 28' perforated in the electromagnetic plunger 1' and a side groove 35 engraved around the external periphery thereof and then flows into the electromagnetic valve chamber 32' and is finally sent out of the outlet port 27' through the valve seat 8 and the path 25. Since the liquid sucked from the suction port 26' reaches the inside of the plunger sleeve 11 via the through-holes 36 and 28' perforated in the delivery plunger 2 and the electromagnetic plunger 4 and then flows downward through the inside of the yoke 4', the electromagnetic coils 12 and 13 are thereby cooled. The function of the magnetic circuits in this embodiment are fundamentaly identical with that of FIG. 1 and the same or like characters are provided to the same or like constitutional elements, so that the detailed explanation will be abridged. Especially in FIG. 3, although the annular yoke 4' is so illustrated that it communicates with the lower plate 23 by way of a comparatively thick path portion 40 constructed to be integral therewith, the path portion 40 is constructed to be very thin, but sufficient to serve as sealing. Thus, it substantially functions near open circuit as magnetic circuit.

Figure 4:
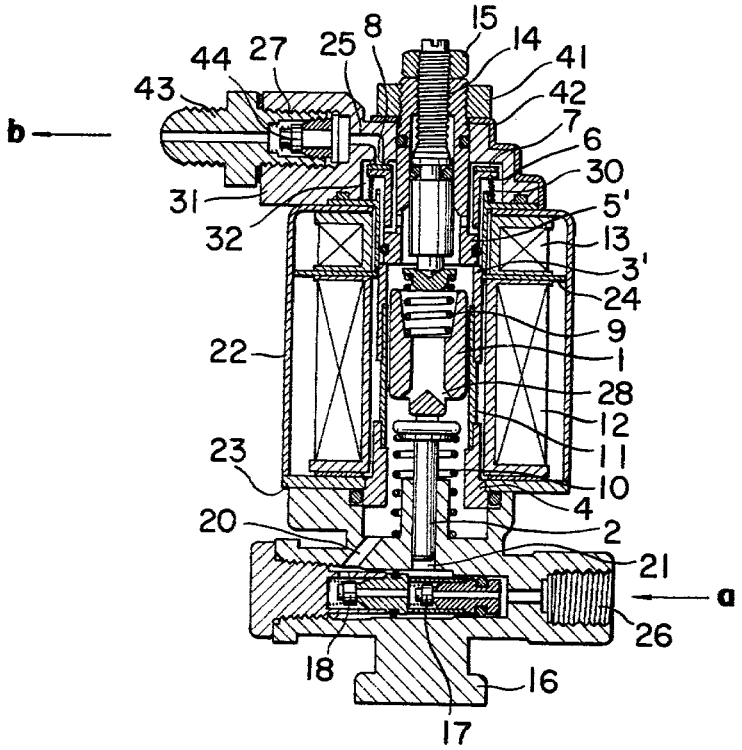
FIG. 4 is a longitudinal and sectional view of a solenoid-type electromagnetic pump in accordance with a third embodiment of the present invention.

Referring to FIG. 4 wherein a still another embodiment is illustrated, the overall construction is generally identical with that of FIG. 1 excepting that an adjusting screw 14 is in screw engagement with the yoke, the sleeve-type moving magnetic core 6 located within the electromagnetic valve chamber 32 is fitted at the outside of the yoke 3, and the thrust spring 30 is disposed at the outer periphery of the moving magnetic core 6. In addition, there is provided a nut 41 on the yoke 3, and the upper body 31, outer casing 22, coils 12 and 13 are thereby held tightly between the yoke 42 surrounding the upper body 31 and the lower plate secured to the main body 16. In order to prevent the fuel oil from leaking due to foreign matters such as dusts and the like attached to the electromagnetic valve when the pump is stopped, a delivery coupling 43 having a check valve 44 therein is connected to the outlet port 27, thereby assuring double safety function.

The function of magnetic circuits in this embodiment is basically identical with that of FIG. 1. However, the magnetic efficiency has been further improved by capturing the leakage flux by use of the yoke 41 and additionally acting it on the moving magentic core 6.

While there has been described and illustrated what is at present considered to be the preferred embodiments of the present invention, it will be appreciated that numerous changes and modifications are likely to occur to those skilled in the art, and it is intended in the appended claims to cover all those changes and modifications which fall within the true spirit and scope of the present invention.

What we claim is:

1. A solenoid-type electromagentic pump to be operated with half-wave rectified current, said electromagentic pump comprising:

a pump body;

a suction port an outlet port defined by surfaces of said pump body;

an elongated chamber extending through said pump body communicating with said suction port and said outlet port;

an electromagnetic plunger and a moving magnetic core movably disposed within said chamber;

a sleeve of nonmagnetic material disposed about said plunger and a magnetic yoke fixedly mounted at each end of said sleeve;

an elongated plunger operating coil disposed about portions of each of said sleeve and yokes;

a valve movable between positions opening and closing said outlet port disposed within said chamber; and a valve operating coil for shifting said valve between said positions electrically connected in the same polarity as said plunger operating coil disposed along the longitudinal axis of said plunger operating coil and adjacent thereto through a magnetic iron plate serving as a common magnetic path for both said coils said valve coil having fewer windings than said plunger coil whereby the magnetic force developed by said valve coil is less than that developed by said plunger coil.

2. A solenoid-type electromagnetic pump as defined in claim 1 wherein said outlet port is positioned at one end of said chamber, said suction portion is positioned at the other end of said chamber and said plunger operating coil is located nearer said suction port than said valve operating coil is located.

* * * * *